United States Patent [19]

England

[11] 4,251,624

[45] Feb. 17, 1981

[54] STABILIZING COLORED PHOTOGRAPHIC PRINT AGAINST FADING AND STAINING

[76] Inventor: Evelyn F. England, 1330 N. Orange Dr., Apt. 111, Hollywood, Calif. 90028

[21] Appl. No.: 14,333

[22] Filed: Feb. 23, 1979

[51] Int. Cl.[2] ..... G03C 7/00; G03C 7/16

[52] U.S. Cl. ..... 430/372; 430/432; 430/463

[58] Field of Search ..... 96/56, 22; 430/372, 430/432, 463

[56] References Cited

U.S. PATENT DOCUMENTS

| | | | |
|---|---|---|---|
| 2,515,121 | 7/1950 | Harsh et al. | 96/22 |
| 3,676,136 | 7/1972 | Mowrey | 96/56 |
| 4,124,391 | 11/1978 | Ogawa et al. | 96/56 |

OTHER PUBLICATIONS

Camerette, Aug. 1949, pp. 117–118.

*Primary Examiner*—Mary F. Downey
*Attorney, Agent, or Firm*—William C. Babcock

[57] ABSTRACT

A method of treating colored photographic prints and film after the full development thereof to prevent the prints or film having stain marks thereon and to stabilize the colored images thereon from fading due to exposure to light, high humidity and high temperatures.

3 Claims, No Drawings

STABILIZING COLORED PHOTOGRAPHIC PRINT AGAINST FADING AND STAINING

BACKGROUND OF THE INVENTION

1. Field of the Invention

Stabilizing Colored Photographic Print Against Fading and Staining.

2. Description of the Prior Art

Colored photographic prints and films resulting from any one of the present day commercial developing processes may have stain marks thereon and are also subject to fading due to exposure to light, high humidity and high temperature.

A major object of the present invention is to provide a process in which the colored print or film after being fully developed has stain marks eliminated therefrom and the color images prevented from fading.

DESCRIPTION OF THE PREFERRED EMBODIMENTS

Color prints and color film may be treated to minimize them from being stained or fading when exposed to direct sunlight, ultra violet light, high humidity and high temperature by immersing them face up in any of the following examples:

1. 1500 ML.Formaldehyde (37%)
1000 ML.Acetic Acid (4% or 5%)
454 Grams Sodium Chloride (NACL)
Either distilled or plain water works with this formula, as most water contains magnesium and calcium which are not harmful, and provides minerals, which help in the hardening process. Add to make one gallon. Saturate by turning protographs over for a period of five minutes.

2. For a stronger solution, and shortening the processing time, at the same time:
1650 ML.Formaldehyde (37%)
1000 ML-Acetic Acid
454 Grams Sodium Chloride
Water to make a gallon with thorough saturation at three minutes.

3. For a stronger solution, and shortening the processing time, at the same time, three minute saturation time will be sufficient time.

1800 ML.Formaldehyde (37%)
1000 ML.Acetic Acid
500 Grams Sodium Chloride (NACL)
Water to make one gallon.

4. 1200 ML.Formaldehyde (37%)
1000 ML.Acetic Acid
500 Grams Sodium Chloride (NACL)
Water to make a gallon. The soaking or saturation time will be longer, however, because the solution is weaker, but is sufficient to successfully control the problem of fading the color print by any adverse conditions, and I have proved this out, soaking time should be at least ten minutes.

5. 1892 ML.Formaldehyde (37%)
1000 ML.Acetic Acid
500 Grams Sodium Chloride
Water to make one gallon. The time of saturation must be shortened slightly to two full minutes. A final rinse in distilled white vinegar one half minute (4½%) will give the print a nice smooth finish, but is not absolutely needed for the success of a beautiful print.

The use and operation of the invention has been described previously in detail and need need not be repeated.

What is claimed is:

1. An after treatment method of treating developed color print and color film to stabilize them from staining and fading when exposed to direct sunlight, ultraviolet light, high temperatures and high humidity which includes the step of:

a. preparing an aqueous solution containing formaldehyde, acetic acid and sodium chloride; and b. immersing said color print and color film in said solution for a period of time not greater than ten minutes to stabilize said color thereon from fading.

2. The method of treatment as defined in claim 1 which includes the further step of:

c. rinsing said print after removal from said solution with an aqueous solution of white vinegar.

3. The method as defined in claim 1 in which each gallon of said solutions contains between:

a. 1200 to 1892 ml. of formaldehyde;

b. substantially 1000 ml. of acetic acid; and c. 450 to 500 grams of sodium chloride.

* * * * *